US005641369A

United States Patent [19]

Kirchhoff et al.

[11] Patent Number: 5,641,369

[45] Date of Patent: Jun. 24, 1997

[54] WRIST REST ASSEMBLY

[75] Inventors: Kenneth J. Kirchhoff, Gem Lake; Robert J. Wolf, Woodbury, both of Minn.

[73] Assignee: Minnesota Mining and Manufacturing Company, St. Paul, Minn.

[21] Appl. No.: 646,414

[22] Filed: May 7, 1996

Related U.S. Application Data

[62] Division of Ser. No. 324,734, Oct. 18, 1994, Pat. No. 5,547,145.

[51] Int. Cl.[6] ..... B32B 31/16

[52] U.S. Cl. ..... 156/73.1; 156/308.4; 156/309.6; 264/445

[58] Field of Search ..... 156/73.1, 290, 156/292, 293, 308.2, 308.4, 309.6; 264/442, 443, 445

[56] References Cited

U.S. PATENT DOCUMENTS

| | | | |
|---|---|---|---|
| 3,676,387 | 7/1972 | Lindlof | 260/28.6 |
| 4,545,554 | 10/1985 | Latino et al. | 248/118.1 |
| 4,770,730 | 9/1988 | Abe | 156/73.1 |
| 4,798,639 | 1/1989 | Yamaguchi | 156/73.1 |
| 5,125,606 | 6/1992 | Cassano et al. | 248/118 |
| 5,163,646 | 11/1992 | Engelhardt | 248/118 |
| 5,169,360 | 12/1992 | Saunders | 482/52 |
| 5,183,230 | 2/1993 | Walker et al. | 248/118 |
| 5,213,554 | 5/1993 | Goldstein et al. | 482/52 |
| 5,219,136 | 6/1993 | Hassel et al. | 248/118 |
| 5,234,186 | 8/1993 | Powell | 248/118.1 |
| 5,242,139 | 9/1993 | Aldrich | 248/118 |
| 5,352,168 | 10/1994 | Wilkinson | 482/55 |
| 5,356,099 | 10/1994 | Sereboff | 248/118.1 |
| 5,421,543 | 6/1995 | Rossman et al. | 248/118.3 |
| 5,443,237 | 8/1995 | Stadtmauer | 248/441.1 |

FOREIGN PATENT DOCUMENTS 1268431 3/1972 United Kingdom .

*Primary Examiner*—James Sells

*Attorney, Agent, or Firm*—Gary L. Griswold; Walter N. Kirn; William L. Huebsch

[57] ABSTRACT

A wrist rest assembly for use along the front edge of a device to be operated by a person's hands or fingers, such as in front of a computer keyboard, including an elongate base assembly on which is supported an elongate pad. The base assembly has a top portion supporting the pad, a bottom portion adapted to be supported on a horizontal surface and structure that allows the top portion to be supported on the bottom portion with the top surface of the pad at two different distances above that horizontal surface by switching ends of the top portion with respect to the ends of the bottom portion.

2 Claims, 5 Drawing Sheets

WRIST REST ASSEMBLY

This is a division of application Ser. No. 08/324,734 filed Oct. 18, 1994 U.S. Pat. No. 5,547,145.

TECHNICAL FIELD

The present invention relates to wrist rest assemblies for use along the front edges of devices to be operated by a person's hands or fingers, such as in front of a computer keyboard, computer mouse or other input device.

BACKGROUND OF THE INVENTION

Wrist rest assemblies are known for use along the front edge of a device to be operated by a person's hands or fingers, such as in front of a computer key board, computer mouse or other input device. It has been suggested that the use of such wrist rest assemblies can restrict damage to wrists from prolonged use of such devices. Heretofore, however, many known wrist rest assemblies have been formed with layers of cushioning material that do not provide the quality of support for the wrists that may be desired.

U.S. patent application Ser. No. 08/253,510 filed Jun. 3, 1994, and assigned to the assignee of this application discloses a wrist rest assembly for use along the front edge of a device to be operated by a person's hands or fingers, such as in front of a computer key board, computer mouse or other input device, which wrist rest assembly provides a layer of cushioning material that can provide better support for the wrists than has heretofore been provided, and further affords a degree of movement of the supported wrist relative to the surface on which the wrist rest is supported that has not been provided by known prior art wrist rest assemblies. That wrist rest assembly comprises (1) a base assembly having an upper pad support surface, which base assembly has a bottom or supported surface adapted to be supported on a horizontal surface along the front edge of the device; and (2) a pad comprising a layer of gel. A bottom surface of the elongate pad is supported on the upper pad support surface of the base assembly, and the pad has a sufficient width between its edges and thickness between its top and bottom surfaces (e.g., a thickness in the range of about ⅛ inch to 5 inches and a width in the range of about ½ to 10 inches with the larger widths providing both wrist and fore arm support) to afford supporting a users wrists on the top surface to help keep the wrists in a neutral position with a portion of the layer of gel beneath and conforming to the supported wrists to distribute the weight of the wrists over a wide area and affording significant motion of the top surface of the pad with the supported wrists relative to the bottom surface in a plane generally parallel to the upper surface of the base assembly.

Preferably the gel is a stable elastomeric block polymer gel similar to the gel described in U.S. Pat. No. 3,676,387, (the content whereof is hereby incorporated herein by reference) and preferably is the gel described in Example No. 3 of British Patent No. GB 1,268,431 (the content whereof is hereby incorporated herein by reference) except that the ratio of oil to block copolymer is in the range of 4 to 1 to 10 to 1 rather than being 5 to 1 as is described in that Example No.3. That gel is quite similar to the gel in the pad commercially available from Minnesota Mining and Manufacturing Company, St. Paul, Minn., under the trade designation "Reston (T. M.) Flotation Pad", which pad for many years has been used in beds, wheel chairs and the like to prevent pressure points. The base assembly described in that application included a top portion having the upper pad support surface supporting the bottom surface of the elongate pad; a bottom portion having the bottom supported surface adapted to be supported on a horizontal surface; and means for supporting the top portion on the bottom portion with the elongate pad at a predetermined one of several different distances above the supported surface; that means being provided by the top portion of the base assembly comprising longitudinally extending rails projecting outwardly in opposite directions generally parallel to its upper pad support surface, and the bottom portion including generally parallel spaced vertically upwardly projecting support portions having opposed surfaces defining sets of grooves parallel to the supported surface and vertically spaced along the support portions, each of which sets of grooves is adapted to receive the rails to support the top portion with the top surface of the elongate pad at a different distance above the supported surface depending on which set of grooves the rails are engaged in.

DISCLOSURE OF THE INVENTION

The present invention provides a wrist rest assembly that is similar in many ways to the wrist rest assembly described in U.S. patent application Ser. No. 08/253,510 filed Jun. 3, 1994, in that it uses the same gel in a pad of similar dimensions and is adjustable in height, but which has a simpler height adjustment means and is assembled by a novel and efficient assembly method.

According to the present invention there is provided a wrist rest assembly comprising a base assembly having an upper pad support surface and an opposite bottom supported surface adapted to be supported on a horizontal surface along the front edge of the device; and a pad comprising a layer of gel. The base assembly comprises an elongate top portion having the upper pad support surface on which the bottom surface of the elongate pad is supported; and a bottom portion having the bottom surface adapted to be supported on a horizontal surface that comprises an elongate part. The top and bottom portions have engaging portions adapted for engagement in a first relative orientation with the first ends of the top portion and the elongate part of the bottom portion adjacent and their second ends also adjacent, and with the top surface of the elongate pad supported at a first predetermined distance above the bottom surface. The top and bottom portions are also adapted for engagement in a second relative orientation with the first end of the top portion adjacent the second end of the elongate part of the bottom portion and the second end of the top portion adjacent the first end of the elongate part of the bottom portion, and with the top surface of the elongate pad supported at a second predetermined distance above the bottom surface.

Preferably, the bottom portion has a peripheral wall with a channel along its inner surface, and the top portion has a lip projecting at generally a right angle to its upper pad support surface adapted to be received in the channel in either of the relative orientations described above to retain the top portion in alignment with the bottom portion. The top portion has a plurality of support members projecting at generally a right angle to its upper pad support surface, and the bottom portion has a plurality of first support surfaces adapted to be engaged by and to support the support members in their first relative orientation, and a plurality of second support surfaces adapted to be engaged by and to support the support members in their second relative orientation.

Also, preferably the top portion has a groove in that lip adjacent and extending entirely around the upper surface, the pad comprises a flexible cover layer around the side of the gel opposite the upper pad support surface and a layer of polymeric material along the side of the gel adjacent the pad support surface with portions of those layers around the layer of gell being in that groove, and the wrist rest assembly includes a sealing member in the groove on the side of those layers opposite the top member, which sealing member is attached to the top portion to retain those portions of the layers in the groove. This structure affords a novel and efficient method of assembly for the wrist rest assembly.

BRIEF DESCRIPTION OF THE DRAWING

The present invention will be further described with reference to the accompanying drawing wherein like reference numerals refer to like parts in the several views, and wherein.

DETAILED DESCRIPTION OF THE PREFERRED EMBODIMENT

Figure 5:
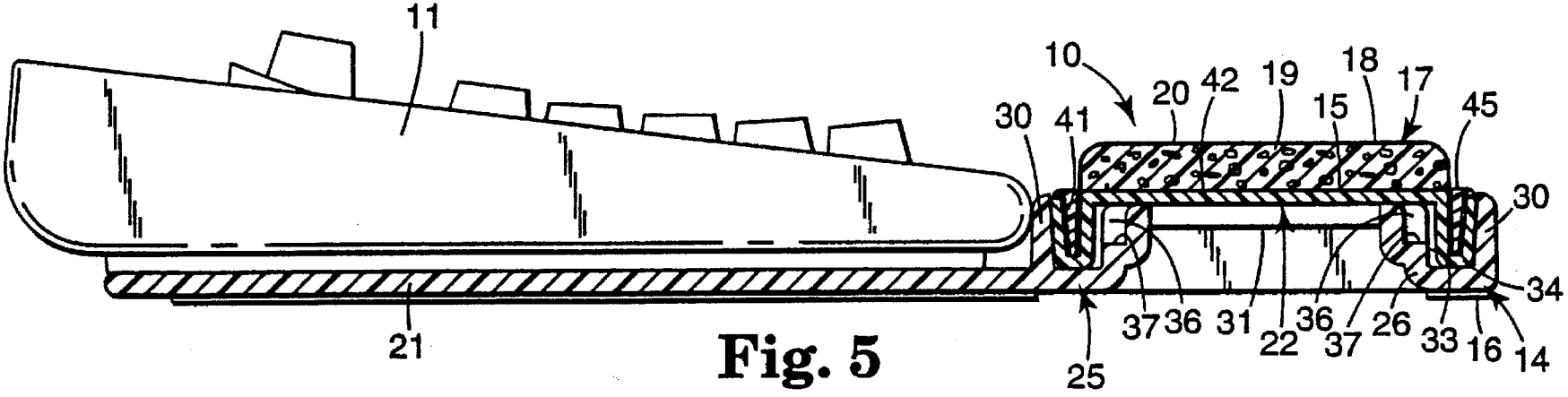
FIG. 5 is a sectional view taken approximately along lines 5—5 of FIG. 1 that illustrates the top and bottom portions of the base assembly for the wrist rest in their first relative orientation and illustrates the wrist rest in combination with a computer keyboard.
Figure 6:
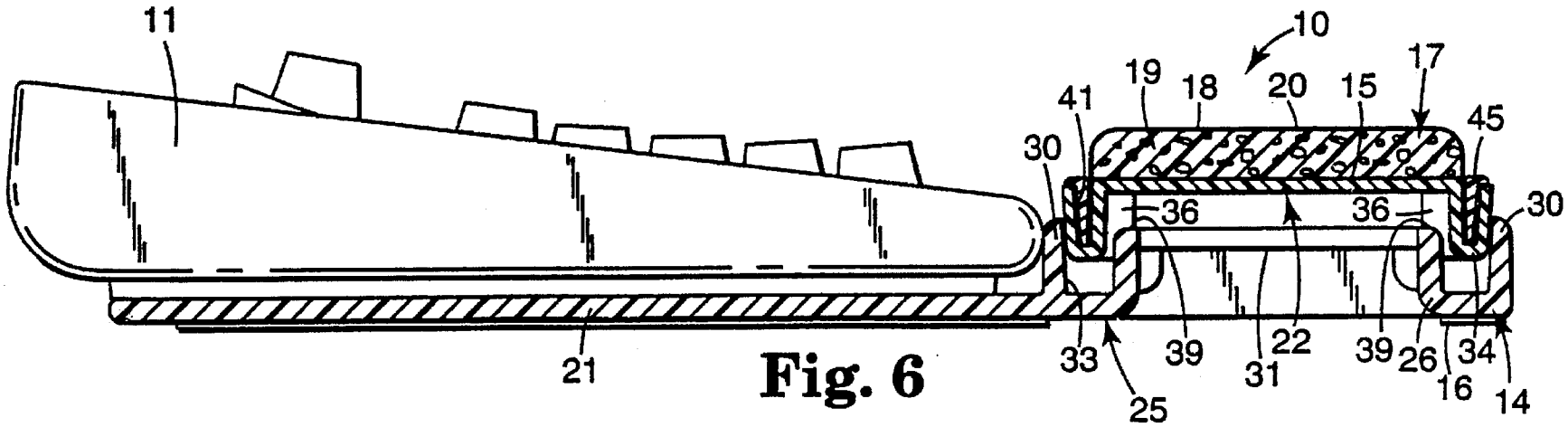
FIG. 6 is a sectional view taken approximately along lines 6—6 of FIG. 4 that illustrates the top and bottom portions of the base assembly for the wrist rest in their second relative orientation and illustrates the wrist rest in combination with a computer keyboard.

Referring now to the drawing there is illustrated a wrist rest assembly according to the present invention, generally designated by the reference numeral 10. The wrist rest assembly 10 is adapted for use along the front edge of a device to be operated by a person's hands or fingers, such as in front of a computer keyboard 11 as is illustrated in FIGS. 5 and 6, to provide support for the wrists of a person using the keyboard 11. The wrist rest assembly, optionally, can be long enough to also have a portion in front of an adjacent computer mouse, or a separate shorter wrist rest assembly can be provided that is only long enough to be used in front of a computer mouse.

Generally, the wrist rest assembly 10 comprises (1) a base assembly 14 having an elongate upper pad support surface 15 (see FIGS. 5 and 6), which base assembly 14 has a bottom supported surface 16 generally parallel to its upper pad support surface 15 adapted to be supported on a horizontal surface along the front edge of the keyboard 11; and (2) an elongate pad 17 comprising a flexible liquid impervious covering layer 18 and a layer of gel 19 under the covering layer 18. The pad 17 has a sufficient thickness between its top and bottom surfaces and sufficient width between its edges to afford supporting a users wrists along its top surface 20 with a portion of the layer of gel 19 beneath and conforming to the supported wrists and affording significant motion of the top surface 20 of the pad with the supported wrists relative to its bottom surface in a plane generally parallel to the upper pad support surface 15 of the base assembly 14. As an example, when the gel 19 is that gel described in Example No. 3 in British Patent No. GB 1,268,431 except that the ratio of oil to block copolymer is 6 to 1 rather than being 5 to 1 as is described in that Example No. 3; the layer of that gel 19 has a thickness of about ⅜ inch and a width between the edges of the pad 17 of about 2.9 inches; and the covering layer 18 comprises a layer of 0.002 inch thick polyurethane; that motion of the top surface 20 of the pad with a supported wrist relative to its bottom surface in a plane generally parallel to the pad support surface 15 of the base assembly 14 allows the supported wrist and the users hand to move in any direction in a generally circular area having a diameter of about one inch. The area of such movement could be made larger or smaller by using different gel compositions, but for most embodiments of the wrist rest should be a circular area having a diameter of at least ½ inch.

Figure 1:
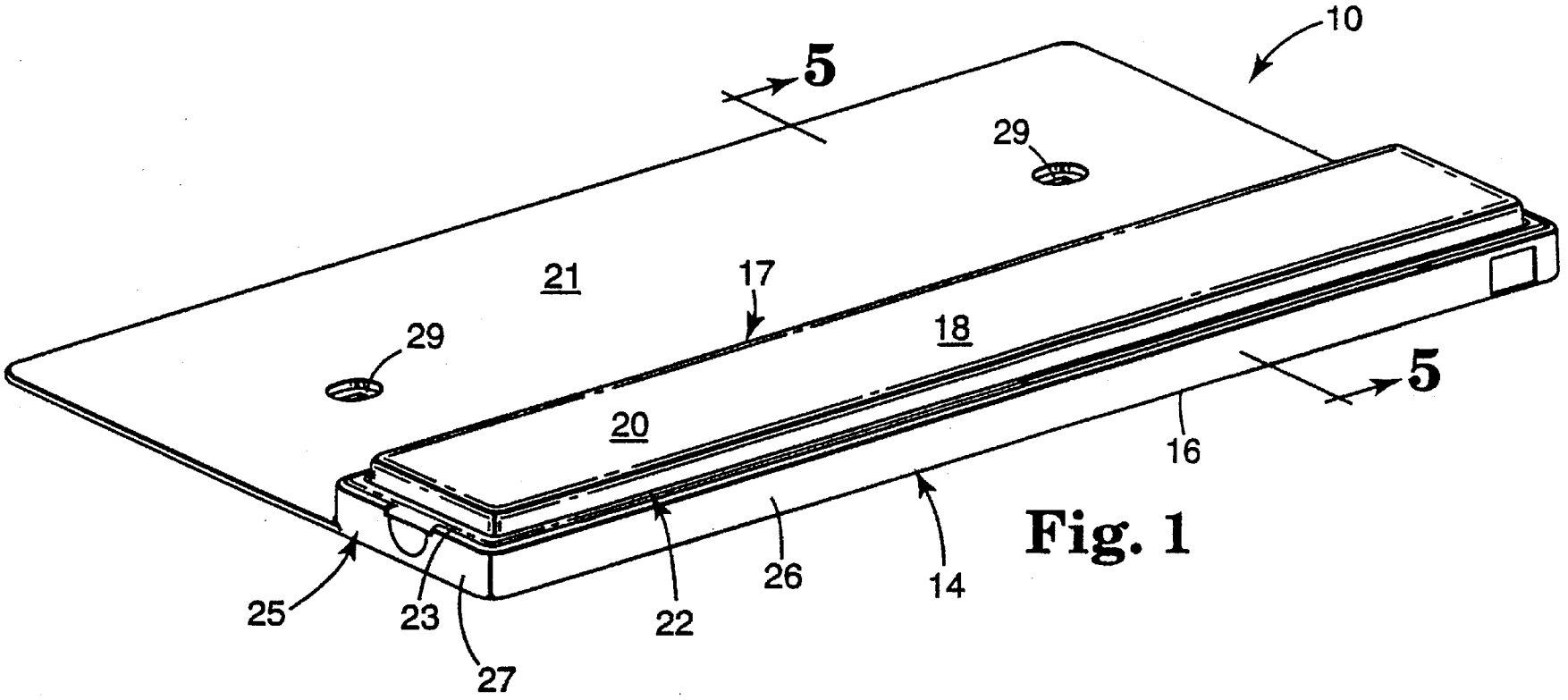
FIG. 1 is a perspective view illustrating a wrist rest assembly according to the present invention with a top and bottom portions of a base assembly for the wrist rest assembly in a first relative orientation.
Figure 2:
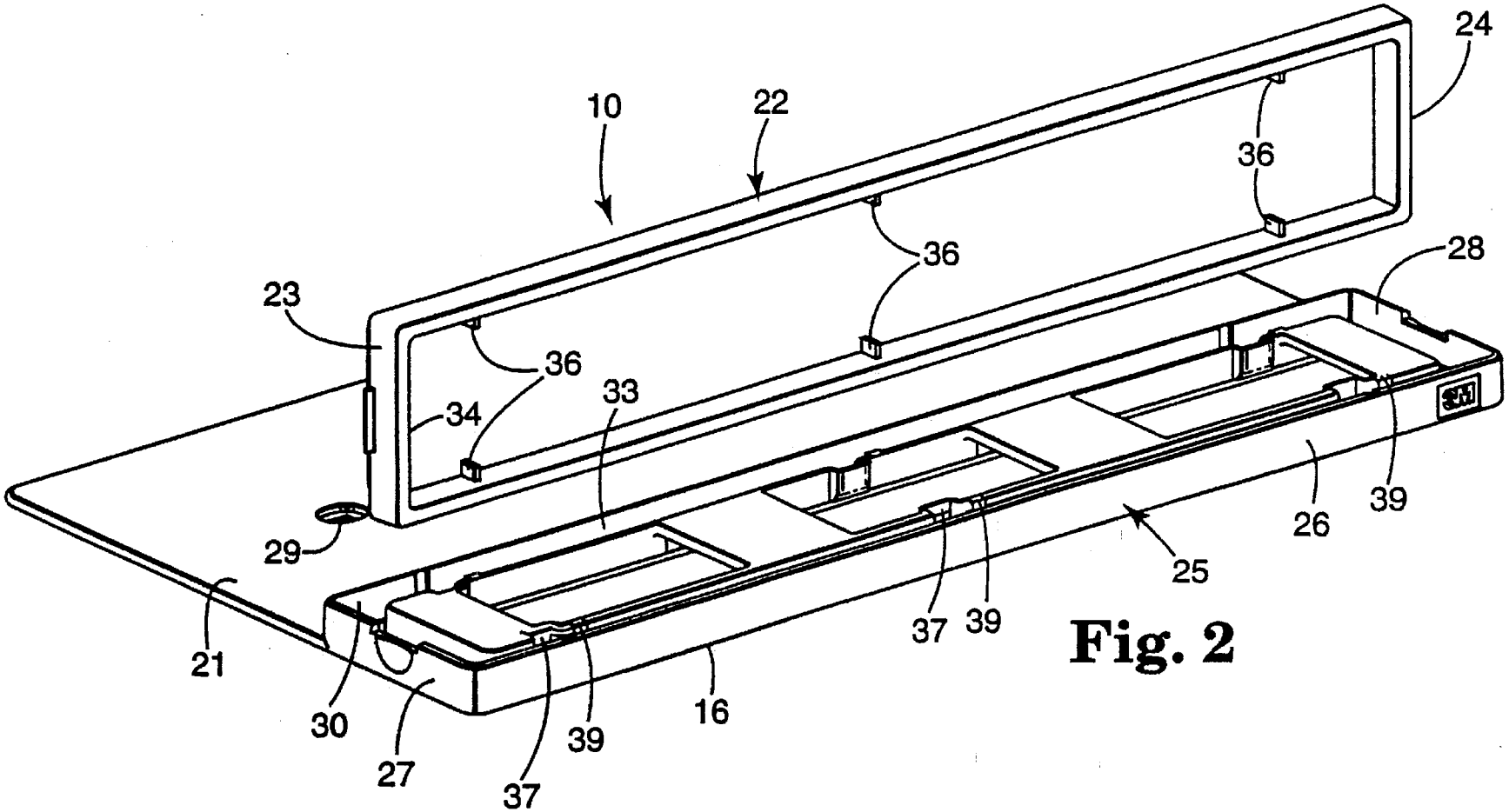
FIG. 2 is a perspective view of the wrist rest assembly of FIG. 1 in which the top and bottom portions of the base assembly included in the wrist rest assembly are separated and the top portion is rotated to illustrated details of the mating surfaces of the top and bottom portions.
Figure 3:
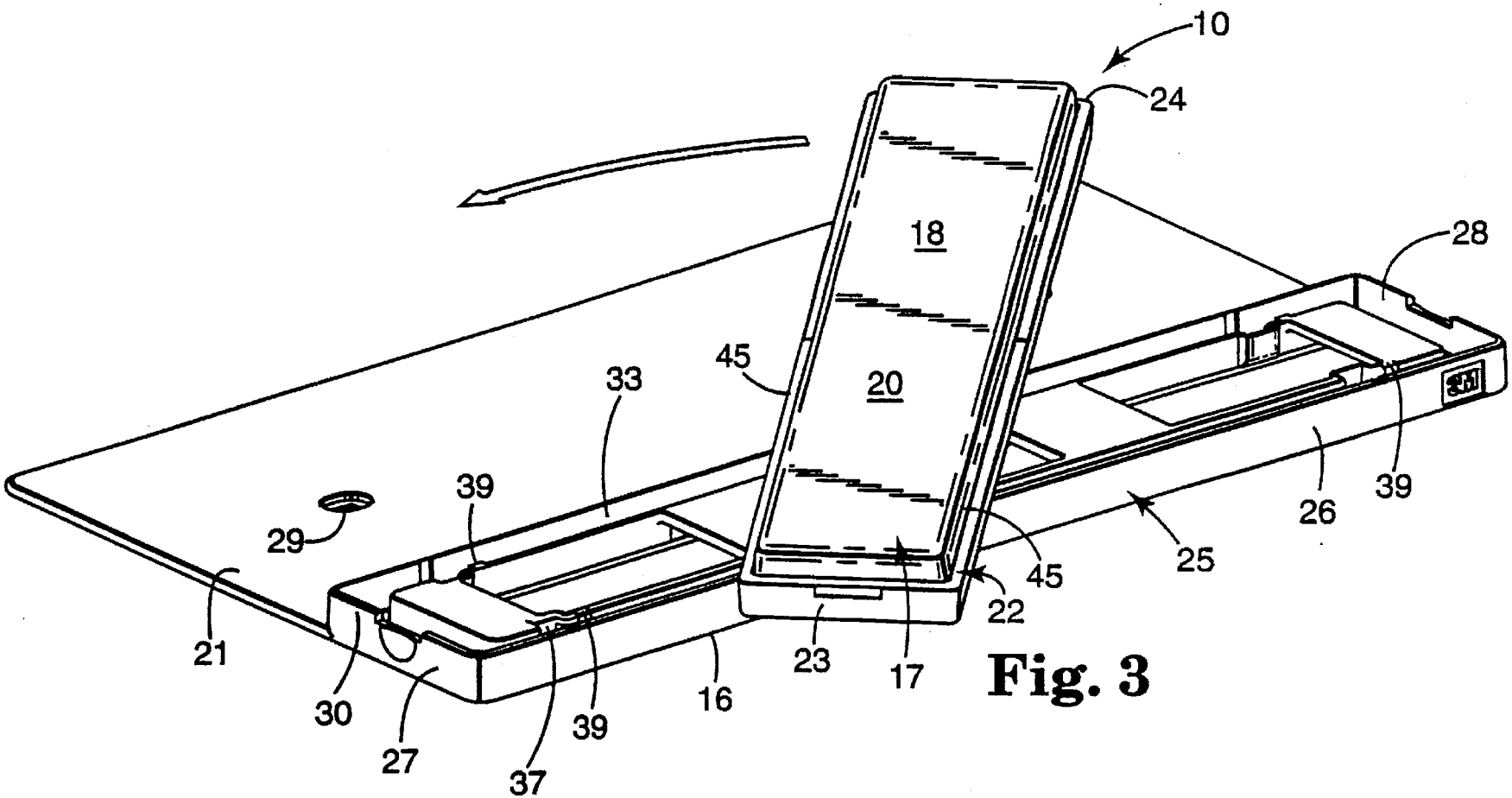
FIGS. 3 and 4 illustrate changing the relative orientations of the top and bottom portions of the base assembly to a second relative orientation illustrated in FIG. 4.
Figure 4:
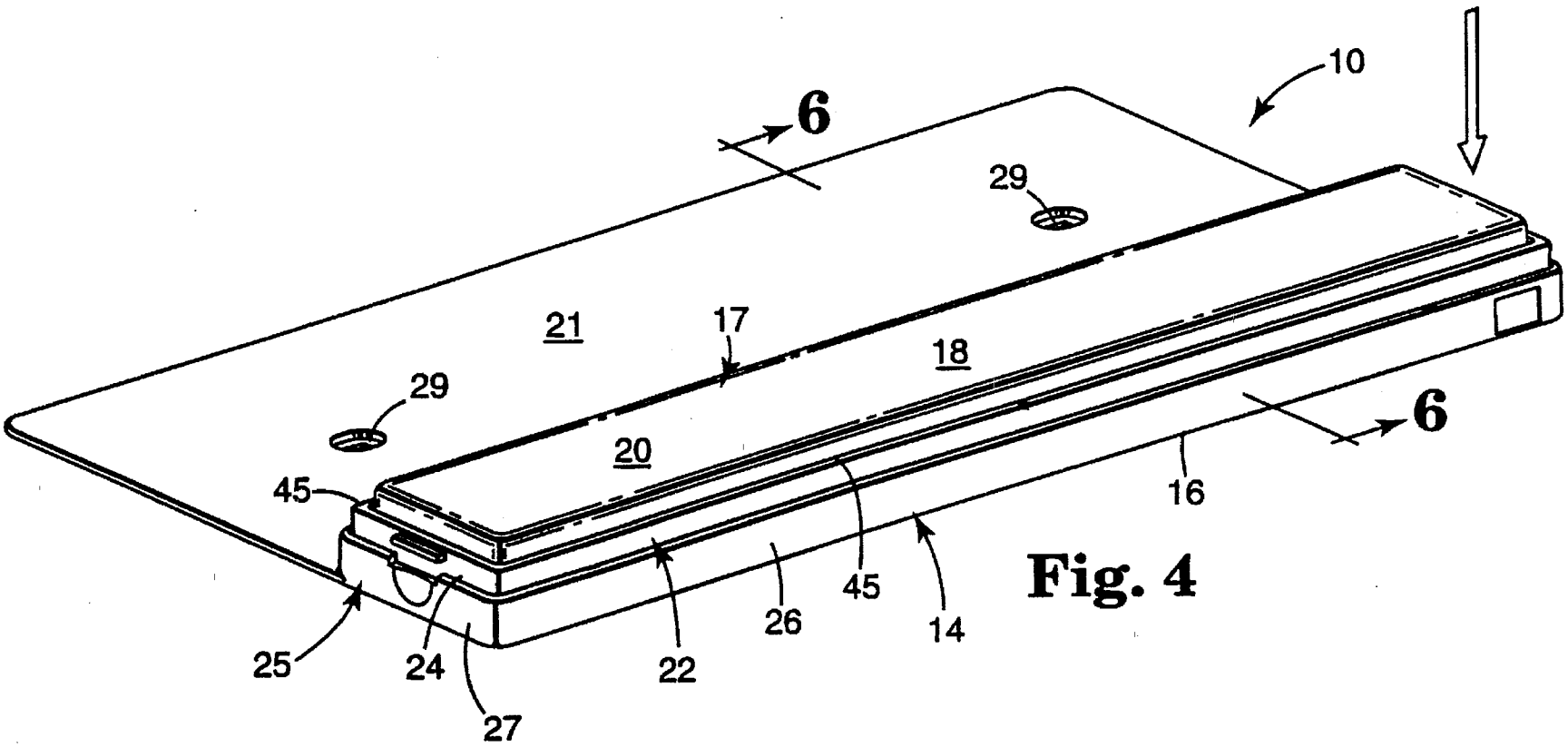

The base assembly 14 of the wrist rest assembly comprises an elongate top portion 22 having the upper surface 15 supporting the bottom surface of the elongate pad 17 and having first and second ends 23 and 24; and a bottom portion 25 having the bottom surface 16 adapted to be supported on a horizontal surface. The bottom portion 25 comprises an elongate part 26 having first and second ends 27 and 28. The bottom portion 25 also includes a rectangular tray 21 on an upper surface of which the computer keyboard 11 can be supported, which tray 21 has spaced openings 29 through which fasteners may attach it to a substrate. The bottom portion 25 has a recess 31 along its bottom surface (see FIGS. 5 and 6) that can receive ledges present on some types of commercially available keyboard support trays. The top portion 22 and the elongate part 26 of the bottom portion 26 have engaging parts (later to be explained) adapted for engagement in a first relative orientation illustrated in FIGS. 1 and 5 with their first ends 23 and 27 adjacent and with their second ends 24 and 28 also adjacent, and with the top surface 20 of the elongate pad 17 supported at a first predetermined distance with respect to the bottom portion 25 (e.g., about 1,025 inches above the upper surface of the tray 21). Those engaging parts are also adapted for engagement in a second relative orientation illustrated in FIGS. 4 and 6 with the first end 23 of the top portion 22 adjacent the second end 28 of the elongate part 26 of the bottom portion 25, the second end 24 of the top portion 22 adjacent the first end 27 of the elongate part 26 of the bottom portion 25, and with the top surface 20 of the elongate pad 17 supported at a second predetermined distance with respect to the bottom portion 25 (e.g., about 1.345 inches above the upper surface of the tray 21). Those engaging parts include a peripheral wall 30 on the bottom portion part 26 that has outer and inner surfaces and a channel 33 along its inner surface, and a lip 34 on the top portion 22 that projects at generally a right angle to the pad support surface 15 and is adapted to be received in the channel 33 in either of their relative orientations to maintain the top and bottom portions 22 and 26 in register with each other. Those engaging portions also include a plurality of or six support members 36 included in the top portion 22 that project at generally a right angle with respect to the pad support surface 15, and a plurality of recessed first support surfaces 37 facing upwardly on the elongate part 26 of the bottom portion 25 adapted to be engaged by and to support the support members 36 with the top and bottom portions 22 and 26 in their first relative orientation; together with a plurality of second support surfaces 39 facing upwardly on the elongate part 26 of the bottom portion 25 adapted to be engaged by and to support the support members 36 with the top and bottom portions 22 and 26 in their second relative orientation. As illustrated, the support members 36 are disposed in a rectangular array disposed slightly closer to the first end 23 of the top portion 22 than to its second end 24. Thus when the first end 23 of the top portion 22 is adjacent the first end 27 of the elongate part 26 of the bottom portion 25, the support members 36 will engage the first support surfaces 37, whereas when the first end 23 of the top portion 22 is adjacent the second end 28 of the elongate part of the bottom portion 25, the support members 36 will engage the second support surfaces 39 which are adjacent the first support surfaces 37, but are elevated above them. The top portion 22 can easily be positioned in either of its orientations relative to the bottom portion 25 by simply lifting it from the bottom portion 26 and again positioning it on the bottom portion 26 with its ends 23 and 24 appropriately positioned with respect to the ends 27 and 28 of the bottom portion 26 as is illustrated in FIGS. 3 and 4.

The wrist rest assembly includes a novel means for attaching the layer of gel 19 along the pad support surface 15 of the top portion 22. The top portion 22 has a generally v-shaped groove 41 in the lip 34 adjacent and extending entirely around the pad support surface 15. The layer of gel 19 is sandwiched between a bottom layer 42 of flexible liquid impervious polymeric material (e.g., 0.005 inch thick poyurethane) between the layer of gel 19 and the pad support surface 15, and the elongate covering layer 18, that preferably is a laminate comprising an inner layer of flexible liquid impervious polymeric material and an outer layer of soft conformable material adapted for comfortable contact with a users wrists (e.g., a nonwoven polyurethane material). Portions of both the bottom layer 42 and of the covering layer 18 project around the periphery of the layer of gel 19 and are positioned in the groove 41. The wrist rest assembly 10 includes a sealing member 45 in the groove 41 on the side of the covering layer 18 opposite the top portion 22, which sealing member 45 is attached to the top portion 22 to retain those portions of both the bottom layer 42 and of the covering layer 18 in the groove 41. One useful method of attaching the sealing member 45 to the top portion 22 is to sonic weld at spaced locations between the sealing member 45 and the part of the top portion 22 defining the bottom of the groove 41, which sonic welding is done through the covering layer 18 and the bottom layer 42.

To attach the layer of gel 19 to the base assembly 14 of the wrist rest assembly 10, the elongate layer of gel 19 is positioned along the bottom layer 42. The covering layer 18 is then positioned on the side of the layer of gel 19 opposite bottom layer 42. The resulting laminate is then positioned along the upper pad support surface 15 of the base assembly 14 with the portions of the bottom layer 42 and the covering layer 18 around the periphery of the layer of gel 19 positioned over the groove 41. The sealing member 45 is then pressed into the groove 41 and carries with it the portions of the bottom layer 42 and the covering layer 18 around the periphery of the layer of gel 19, and the sealing member 45 is attached to the base assembly 14 (e.g., by sonic welding as described above) to retain those portions in the groove 41.

The present invention has now been described with reference to one embodiment thereof. It will be apparent to those skilled in the art that many changes can be made in the embodiment described without departing from the scope of the present invention. For example: the wrist rest assembly can be made any length; the pad support surface of the base assembly could have shapes other than generally planar such as being arcuate around a longitudinal axis to make it, for example, cylindrically convex or concave, or could have transverse recesses below where a users wrists would normally be supported. Thus, the scope of the present invention should not be limited to the structure described in this application, but only by the structure described by the language of the claims and the equivalents thereof.

We claim:

1. A method of making a wrist rest assembly for use along the front edge of a device to be operated by a person's hands or fingers comprising:

providing a base assembly having an elongate upper pad support surface and a groove adjacent and extending around the upper surface;

positioning an elongate layer of gel along an elongate bottom layer of polymeric material;

positioning a flexible liquid impervious covering layer on the side of the layer of gel opposite the bottom layer;

positioning the resultant laminate along the upper pad support surface of the base assembly with portions of the bottom layer and the covering layer around the periphery of the layer of gel extending over the groove;

pressing a sealing member into the groove so that the sealing member carries with it the portions of the bottom layer and the covering layer around the periphery of the layer of gel; and attaching the sealing member to the base assembly.

2. A method according to claim 1 wherein said step of attaching the sealing member to the base assembly comprises sonic welding the sealing member to the base assembly through the portions of the bottom layer and the covering layer around the periphery of the layer of gel.

* * * * *